US007854019B2

(12) United States Patent
Delaney

(10) Patent No.: US 7,854,019 B2
(45) Date of Patent: Dec. 21, 2010

(54) GARMENT ACCESSORY

(76) Inventor: Catherine Delaney, 5325 Avanshire La., Cumming, GA (US) 30040

( * ) Notice: Subject to any disclaimer, the term of this patent is extended or adjusted under 35 U.S.C. 154(b) by 0 days.

(21) Appl. No.: 12/266,283

(22) Filed: Nov. 6, 2008

(65) Prior Publication Data

US 2009/0113601 A1 May 7, 2009

Related U.S. Application Data

(60) Provisional application No. 60/985,774, filed on Nov. 6, 2007.

(51) Int. Cl.
*A41D 27/02* (2006.01)
*A41D 27/12* (2006.01)

(52) U.S. Cl. ..... 2/232; 2/46

(58) Field of Classification Search ..... 2/231, 2/232, 233, 46, 60, 227, 61, 69, 272, 269, 2/267, 244, 243.1, 455, 238, 51, 47, 97, 222, 2/338; 36/70 R, 96, 88, 136, 138
See application file for complete search history.

(56) References Cited

U.S. PATENT DOCUMENTS 176,292 A * 4/1876 Gardner ..... 2/232
771,021 A 9/1904 Lux
2,438,280 A * 3/1948 Gailey ..... 36/55
2,574,669 A * 11/1951 Snider ..... 2/232
3,168,749 A * 2/1965 Cala ..... 2/269
4,980,927 A * 1/1991 Wawiluk et al. ..... 2/60
5,590,420 A 1/1997 Gunn
5,829,057 A * 11/1998 Gunn ..... 2/69
5,896,580 A * 4/1999 Aldrich et al. ..... 2/24
5,940,882 A * 8/1999 Auguste ..... 2/60
6,362,387 B1 3/2002 Carlson et al.
6,618,862 B1 9/2003 Bunjes
6,701,582 B1 3/2004 Milburn
7,087,806 B2 * 8/2006 Scheinberg et al. ..... 602/41
7,237,306 B1 7/2007 Flowers et al.
7,328,460 B1 * 2/2008 Mancini ..... 2/232
2005/0028252 A1 2/2005 Lockwood
2006/1014378 7/2006 Lockwood
2006/0174389 A1 8/2006 Engel
2006/0213036 A1 9/2006 Flowers et al.
2006/0218698 A1 10/2006 Toyne
2006/0282938 A1 12/2006 Jewell et al.
2007/0028367 A1 2/2007 Allen
2007/0294804 A1 * 12/2007 Pinelli ..... 2/231
2008/0301860 A1 * 12/2008 Iqbal ..... 2/455
2009/0312684 A1 * 12/2009 Leonard et al. ..... 602/44

* cited by examiner

*Primary Examiner*—Amy B Vanatta
(74) *Attorney, Agent, or Firm*—Innovative IP, PLC; Sandra M. Sovinski, Esq.

(57) ABSTRACT

A garment accessory for attachment to a hem of a garment for prevention of entrapment of the garment beneath a foot or shoe of the wearer, comprising an adhesive-backed flexible and conforming film having a low-friction surface.

17 Claims, 1 Drawing Sheet

GARMENT ACCESSORY

CROSS-REFERENCE AND PRIORITY CLAIM TO RELATED APPLICATION

To the fullest extent permitted by law, the present U.S. Non-Provisional Patent Application claims priority to and the benefit of United States Provisional patent application entitled "Garment Accessory," filed on Nov. 6, 2007, on behalf of inventor Catherine Delaney, and having assigned Ser. No. 60/985,774, wherein said application, specifically including all disclosure, figures and photographs is expressly incorporated herein by reference in its entirety.

TECHNICAL FIELD

The present invention relates generally to clothing, and more specifically to a hem attachment for preventing entrapment of the hem beneath a wearer's foot or footwear.

BACKGROUND OF THE INVENTION

A common problem experienced by many individuals relates to the entrapment of a garment, such as pants and skirts, either beneath a wearer's footwear or between the wearer's foot and the wearer's footwear, especially when backless shoes are worn. Such entrapment adversely affects the appearance of the wearer and of the garment itself, and further, involves the risks of soiling and/or damaging the garment. As such, the beneficial prevention of such entrapment would alleviate the undesirable affect on the wearer's appearance, and would further avoid the costs associated with cleaning, repair, or replacement of garments which have been soiled or damaged from such entrapment.

Accordingly, garment stiffening devices have been proposed and implemented in an attempt to provide a solution to the problem of garments becoming trapped beneath a wearer's foot or footwear. These stiffening devices work by attachment of a rigid (at least compared to the garment fabric) member that prevents the garment from bending near the hem, whereby the hem cannot become trapped. Such stiffening devices, however, inevitably fail to provide an adequate solution, especially for highly flexible fabrics and/or garments that are intended to flow or exhibit movement, because addition of the rigid member necessarily alters the structural characteristics of the garment. In many instances, such structural characteristics may not be altered without making the garment unsuitable to the wearer's needs or preferences.

Thus, it is clear that what is needed is a garment accessory that is capable of preventing entrapment of the garment beneath a wearer's foot or footwear that does not adversely affect the structural characteristics of the garment, whereby the aesthetic attributes of the garment are not altered.

BRIEF SUMMARY OF THE INVENTION

Briefly described, in a preferred embodiment, the present invention overcomes the above-mentioned disadvantages and meets the recognized need for such a device by providing a removable garment accessory for attachment to an inside of a garment, proximate a hem portion thereof, for reducing a coefficient of friction of a surface in contact with a wearer's skin, hosiery, or footwear, whereby the garment may slide over same to prevent entrapment of the garment beneath the wearer's foot or footwear.

According to its major aspects, and broadly stated, the present invention is a garment accessory comprising a thin sheet of flexible material having an adhesive disposed on a first side and an opposing second side having a low coefficient of friction. Specifically, the garment accessory is preferably formed of a thin sheet of polymeric material exhibiting a low coefficient of friction, or having a low-friction coating disposed over a first major surface and having a releasable adhesive coating, such as a pressure sensitive adhesive disposed over at least a portion of an opposing second major surface.

The releasable adhesive is preferably selected such that no staining, residue, or other lasting effect of attachment of the garment accessory remains after removal of the garment accessory, and is further preferably selected such that the garment accessory is securely attached to the garment during use. The sheet material from which the garment accessory is formed and/or the low-friction coating material is/are preferably selected to reduce or prevent accumulation of static electrical charge that may provide an attraction force between the garment accessory and a wearer's foot, footwear, and/or hosiery. The sheet material is preferably further selected such that it provides substantially no rigidity to the portion of the garment to which it is attached, whereby during use, a structural rigidity of the garment, or any portion thereof, is substantially unaltered by the garment accessory, whereby the appearance of the garment is likewise substantially unaltered.

Accordingly, a feature and advantage of the present invention is its ability to prevent entrapment of a garment portion beneath a wearer's foot or footwear via low-friction and/or low static electric attraction sliding engagement of the garment accessory with the wearer's foot, footwear, and/or hosiery.

Another feature and advantage of the present invention is its ability to prevent entrapment of a garment portion beneath a wearer's foot or footwear without substantially altering an appearance of the garment during use or thereafter.

These and other objects, features, and advantages of the invention will become more apparent to those ordinarily skilled in the art after reading the following Detailed Description and Claims in light of the accompanying drawing Figures.

BRIEF DESCRIPTION OF THE DRAWINGS

Accordingly, the present invention will be understood best through consideration of, and reference to, the following Figures, viewed in conjunction with the Detailed Description of the Invention referring thereto, in which like reference numbers throughout the various Figures designate like structure and in which.

It is to be noted that the drawings presented are intended solely for the purpose of illustration and that they are, therefore, neither desired nor intended to limit the invention to any or all of the exact details of construction shown, except insofar as they may be deemed essential to the claimed invention.

DETAILED DESCRIPTION OF THE INVENTION

In describing preferred embodiments of the present invention illustrated in the Figures, specific terminology is employed for the sake of clarity. The invention, however, is not intended to be limited to the specific terminology so selected, and it is to be understood that each specific element includes all technical equivalents that operate in a similar manner to accomplish a similar purpose.

Figure 1:
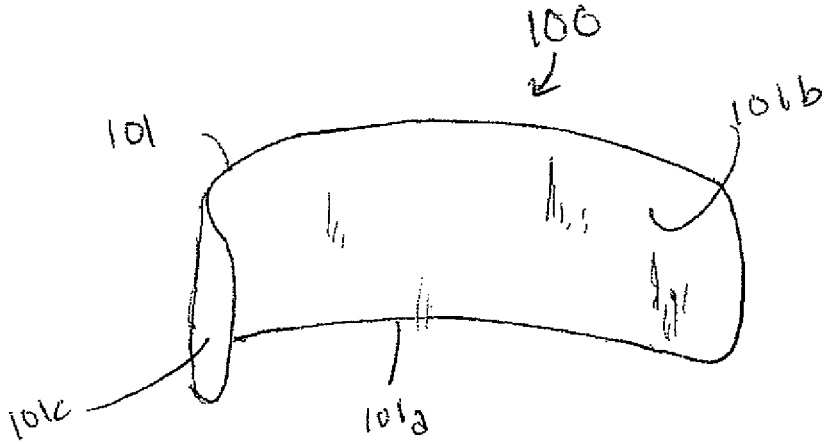
FIG. 1 is a perspective view of a garment accessory according the present invention.
Figure 2:
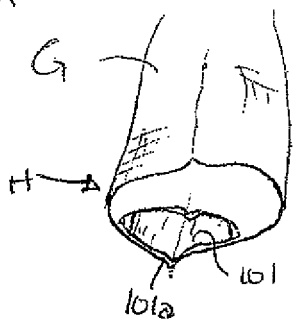
FIG. 2 is a perspective view of the garment accessory shown attached proximate a hem of garment.
Figure 3:
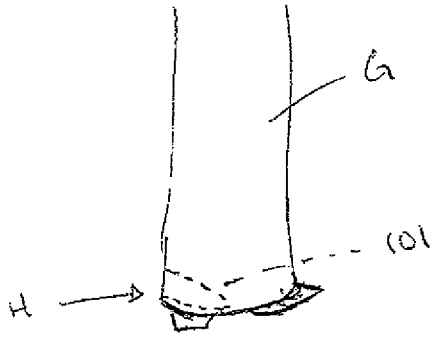
FIG. 3 is a perspective view of a garment with the garment accessory in use therewith.

In that form of the preferred embodiment of the present invention chosen for purposes of illustration, FIGS. 1-3 show garment accessory 100 comprising flexible sheet 101 preferably formed of a continuous or woven polymeric sheet. Garment accessory 100 is preferably adapted for attachment to an interior surface of garment G proximate hem H thereof. As such, garment accessory 100 may include substantially straight bottom edge 101*a*, whereby garment accessory 100 may be disposed proximate a length of hem H of garment G.

Flexible sheet 101 is preferably formed of a polymeric material of suitable durability and rigidity, such as an ultra high molecular weight polyethylene (UHMWP) sheet, a polyester sheet, a polytetraflouroethylene sheet, a high density polyethylene (HDPE) sheet, or the like, having a thickness from approximately 2 mils to approximately 10 mils, whereby a structure of garment G is not substantially altered by attachment of garment accessory 100 thereto. It should be noted that while 2 mils to 10 mils is generally preferred for the thickness of garment accessory 100 according to presently available and economically viable manufacturing alternatives, garment accessory 100 could be of a thickness less than 2 mils without departing from the intended scope thereof. That is, because a targeted feature of garment accessory 100 is the "non-impact" on the natural flow of the garment to which it is adhered, in general, the more thin reasonably achievable for garment accessory 100 while retaining the functionality, the better. It is further noted, however, that for some fabrics, a first particular thickness may be preferred, while for some other fabrics, another second particular thickness may be preferred; for example, a denim garment may benefit from a more thick version of garment accessory 100 than a silk garment. Garment accessory 100 may preferably be formed having dimensions sufficient to cover a substantial portion of an interior surface of garment G likely to come into contact with a wearer's foot, hosiery, and/or footwear, such as the lower approximately two inches of the back half of garment G. Thus, for pants, garment accessory 100 may be formed with dimensions of approximately 9" by 2". Of course, the peripheral dimension of garment accessory 100 is essentially without limitation, wherein a minimal size to accomplish the purpose is preferred, but a larger size to cover a greater area for a given type of garment may also be desirable. As such, lengths greater or less than 9" may be provided, as well as widths greater or less than 2". For skirts, dresses, or the like, a single larger garment accessory 100 may be used, or, alternatively, two or more smaller garment accessories 100 may be used.

Flexible sheet 101 preferably has first major surface 101*b* having a low coefficient of friction, wherein friction forces between garment accessory 100 and a wearer's skin, hosiery, and/or footwear is reduced, whereby garment accessory 100 preferably slides easily thereover. Flexible sheet 101 preferably further has second major surface 101*c* opposing first major surface 101*b* having attachment means 105 disposed over at least a portion thereof, such as a pressure-sensitive adhesive, or other releasable adhesive.

First major surface 101*b* may have a low coefficient of friction by virtue of the material selected for flexible sheet 101, or, alternatively, may include a coating 107 of a material having a low coefficient of friction, including spray on coatings, multiple ply arrangements, and the like. Additionally, second major surface 101*c* may include a paper cover, or other covering 103, to protect an adhesive coating 107 disposed thereon. Alternatively, flexible sheet 101 may be packaged in a folded arrangement, whereby an adhesive on second major surface 101*b* may be used to retain garment accessory 100 in the folded arrangement, and whereby the adhesive may be protected by flexible sheet 101. Additionally, flexible sheet 101 may be formed of a material that resists accumulation of static electrical charge, or may have an anti-static coating applied at least to a portion of first major surface 101*b*. Such anti-static characteristic of flexible sheet 101 preferably prevents or resists static cling between garment G and/or garment accessory 100 and a wearer's skin, hosiery, and/or footwear.

In use, garment accessory 100 may be attached to an inside surface of garment G via the adhesive on second major surface 101*c* thereof. If a backing 103 is supplied, or if packaged in a folded arrangement, the adhesive is preferably exposed prior to attachment. The adhesive preferably attaches to the garment without marring, discoloring, staining, dissolving, or otherwise altering or affecting garment G. Garment accessory 100 is preferably attached to garment G with straight edge 101*a* disposed generally parallel to a bottom of hem H with flexible sheet 101 covering at least a portion of a back portion of the inside surface of garment G proximate hem H thereof. As shown in FIG. 2, if garment G has a crease, seam, or other structure, garment accessory 100 preferably conforms thereto, whereby an external appearance created by such crease, seam, or other structure is not affected.

When garment accessory 100 is so attached to an inside surface of garment G, a wearer's skin, hosiery, and/or footwear preferably engages garment G at a location over which garment accessory 100 is disposed, whereby the low coefficient of friction of first major surface 101*b* allows easy sliding engagement between garment G and the wearer's skin, hosiery, and/or footwear. Such easy sliding engagement preferably prevents garment G, or any portion thereof, from sticking to the wearer's skin, hosiery, and/or footwear, and prevents garment G, or any portion thereof, from becoming trapped beneath the wearer's foot or footwear thereby.

By way of further example, it is noteworthy that a comparative assessment of the two legs of a single pair of pants worn by an individual person, wherein one first leg of the pants had garment accessory 100 attached therewithin, and the other second leg of the pants did not have garment accessory 100 attached therewithin, resulted in an aesthetically appealing, loose hanging first leg of the pants and a visually disconcerting, trapped and generally mangled appearance for the second leg of the pants.

Moreover, a method of use on a pair of pants of an illustrative embodiment of garment accessory 100, such as was utilized in the aforementioned comparative assessment, may be described as follows: (1) a pair of generally rectangular flexible sheets 101 is obtained, wherein first major surface 101*b* is generally exposed, and wherein second major surface 101*c* is protected by covering 103; (2) each flexible sheet 101 is preferably positioned on a flat surface with covering 103 exposed, wherein a peeling back of covering 103 ensues; (3) the target garment, in this example, a pair of pants, is laid out flat on a surface, such as, for exemplary purposes only, an ironing board or countertop, such that either the pants are inside-out, or the bottom region of each leg is turned up a suitable distance; (4) after second major surface 101*c* is exposed by removal of covering 103, each flexible sheet 101 is turned over so that second major surface 101*c* may be pressed against the exposed area of the interior rear portion of each pants leg; (5) when flexible sheet 101 is attached to the pants leg, first major surface 101*b* remains exposed; (6) pants are turned rightside-out and worn with flexible sheet 101 essentially undetectably positioned proximate the rear hem.

Having, thus, described exemplary embodiments of the present invention, it should be noted by those skilled in the art that the within disclosures are exemplary only and that various other alternatives, adaptations, and modifications may be made within the scope and spirit of the present invention. Accordingly, the present invention is not limited to the specific embodiments as illustrated herein, but is only limited by the following claims.

What is claimed is at least:

1. A garment accessory comprising:

a body comprising a sheet of material; and an adhesive disposed only on a first major surface of said body for removable attachment of said body to a garment workpiece having a plurality of vertical movement lines and a plurality of horizontal movement lines, and the garment having a first fabric flow along the plurality of vertical movement lines and a second fabric flow along the plurality of horizontal movement lines, wherein a second major surface of said body opposite said first major surface comprises an adhesive-free, low-friction surface, whereby said garment accessory facilitates sliding movement of the garment workpiece over at least one of a wearer's skin, hosiery, and footwear, without structurally inhibiting the first fabric flow and the second fabric flow of the said garment workpiece, but with permitting free movement of the garment along the vertical movement lines and the horizontal movement lines.

2. A method of preventing entrapment of a garment beneath at least one of a wearer's foot and a wearer's footwear, comprising the steps of:

obtaining a garment accessory having a low-friction surface; and attaching said garment accessory to an interior surface of the garment proximate a hem thereof, the garment having a low initial inherent rigidity, wherein said low-friction surface enables the garment to slide over at least one of a wearer's skin, hosiery, and footwear, whereby entrapment of the garment may be prevented, and, wherein the low level of the initial rigidity of the garment to which said garment accessory is secured is essentially maintained after said attaching of said garment accessory, such that the garment rigidity is not increased after attaching of said garment accessory relative to the rigidity of the garment before said attaching of said garment accessory, and such that inherent garment flow remains unaffected by said garment accessory.

3. A removable garment accessory, comprising:

a generally conformable planar member with a first surface and a second surface, wherein said conformability is such as to avoid impedance with inherent flow along the vertical lines and the horizontal lines of a garment having said removable garment accessory secured thereto, and said conformability is such as to maintain a natural flow of the garment in any and every direction even when said removable garment accessory is secured thereto;

means for removably securing said planar member to a garment;

wherein securing said planar member effectively lowers a coefficient of friction from a first coefficient of friction between a garment and a wearer to a second coefficient of friction between said planar member and a contact point on the wearer, wherein said second coefficient of friction is lower than said first coefficient of friction.

4. The removable garment accessory of claim 3, wherein said generally conformable planar member is a thin sheet of flexible material, wherein said means for removably securing said planar member to a garment is an adhesive, and wherein said first surface of said planar member carries said adhesive.

5. The removable garment accessory of claim 4, wherein said thin sheet of flexible material is a polymeric material exhibiting a low coefficient of friction.

6. The removable garment accessory of claim 4, wherein said second surface of said planar member carries a low-friction coating.

7. The removable garment accessory of claim 4, wherein said adhesive is pressure sensitive adhesive.

8. The removable garment accessory of claim 7, wherein said pressure sensitive adhesive is non-staining and non-residual.

9. The removable garment accessory of claim 4, wherein said thin sheet of flexible material is formed from a material resistant to accumulation of static electrical charge.

10. The removable garment accessory of claim 4, wherein said thin sheet of flexible material is selected from the group consisting of a continuous polymeric sheet and a woven polymeric sheet.

11. The removable garment accessory of claim 3, wherein said generally conformable planar member further comprises a substantially straight bottom edge.

12. The removable garment accessory of claim 4, wherein said thin sheet of flexible material is selected from the group consisting of an ultra high molecular weight polyethylene (UHMWP) sheet, a polyester sheet, a polytetraflouroethylene sheet, and a high density polyethylene (HDPE) sheet.

13. The removable garment accessory of claim 4, wherein said thin sheet of flexible material has a thickness from approximately 2 mils to approximately 10 mils.

14. The removable garment accessory of claim 13, wherein said thin sheet of flexible material is formed with peripheral dimensions of approximately 9" by 2".

15. The removable garment accessory of claim 6, wherein said low-friction coating is derived from the group consisting of spray on coatings and multiple ply arrangements.

16. The removable garment accessory of claim 4, further comprising a removable covering, wherein said covering removably covers said adhesive.

17. The removable garment accessory of claim 4, wherein said thin sheet of flexible material is releasably folded with said adhesive maintaining said releasable fold.

* * * * *